US005858919A

United States Patent [19]

Campbell et al.

[11] Patent Number: 5,858,919

[45] Date of Patent: Jan. 12, 1999

[54] PROCESS FOR MAKING DYE-RECEIVING ELEMENT FOR THERMAL DYE TRANSFER

[75] Inventors: Bruce C. Campbell, Rochester; Colin Martin, Ionio; Patrick M. Thompson, Rochester, all of N.Y.

[73] Assignee: Eastman Kodak Company, Rochester, N.Y.

[21] Appl. No.: 893,801

[22] Filed: Jul. 11, 1997

[51] Int. Cl.[6] ..... B41M 5/035; B41M 5/38

[52] U.S. Cl. ..... 503/227; 427/152; 428/195; 428/211; 428/304.4; 428/512; 428/513; 428/516; 428/910; 428/913; 428/914

[58] Field of Search ..... 427/146, 152; 428/195, 211, 304.4, 512, 513, 516, 910, 913, 914; 503/227

[56] References Cited

U.S. PATENT DOCUMENTS

| | | | |
|---|---|---|---|
| 5,376,432 | 12/1994 | Umise et al. | 428/195 |
| 5,612,283 | 3/1997 | Campbell | 503/227 |

*Primary Examiner*—Bruce H. Hess
*Attorney, Agent, or Firm*—Harold E. Cole

[57] ABSTRACT

This invention relates to a process of preparing a dye-receiving element for thermal dye transfer comprising:

a) applying to a support on the front side thereof a dye image-receiving layer;

b) laminating to the back side of the support a polyolefin layer; and c) subjecting the polyolefin layer to a corona discharge treatment and not applying any subsequent layers thereover.

9 Claims, No Drawings

PROCESS FOR MAKING DYE-RECEIVING ELEMENT FOR THERMAL DYE TRANSFER

FIELD OF THE INVENTION

This invention relates to a process for making a dye-receiving element used in a thermal dye transfer process, and more particularly to making a dye-receiving element containing a microvoided composite film.

BACKGROUND OF THE INVENTION

In recent years, thermal transfer systems have been developed to obtain prints from pictures which have been generated electronically from a color video camera or digital input. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye-receiving elements used in thermal dye transfer generally comprise a polymeric dye image-receiving layer coated on a base or support. Transport through the thermal printer is very dependent on the base properties. For acceptable performance, the dye-receiving element must have low curl under a wide variety of environmental conditions, conditions at which the printer will be operating. From an aesthetics standpoint, it is also desirable for the dye-receiving element to exhibit low curl under the wide variety of environmental conditions at which the print will be displayed or kept.

DESCRIPTION OF RELATED ART

Invention 1 of the Example of U.S. Pat. No. 5,612,283 relates to a dye-receiving element for thermal dye transfer comprising a base having thereon a dye image-receiving layer, wherein the base comprises a polypropylene film laminated to both sides of a cellulosic paper support. No additional backing layer was employed. There is a problem in printing with this receiving element in that the print registration of each color patch is not as good as it could be. The print registration is very important for clear, sharp images. There is another problem in printing with this receiving element in that sometimes the surface characteristics are such that multiple elements are picked from the feed tray at the same time causing a printer jam.

U.S. Pat. No. 5,376,432 relates to a dye-receiver wherein a corona discharge treatment (CDT) is applied to the backside of the element. However, a back coating layer is then applied over the corona-treated backside.

It is an object of this invention to provide a receiver for thermal dye transfer printing which has improved print registration. It is another object of the invention to provide a receiver for thermal dye transfer printing wherein the surface characteristics are improved to prevent multiple elements from being picked from the feed tray at the same time.

SUMMARY OF THE INVENTION

These and other objects are accomplished in accordance with the invention, which relates to a process of preparing a dye-receiving element for thermal dye transfer comprising:

a) applying to a support on the front side thereof a dye image-receiving layer;

b) laminating to the back side of the support a polyolefin layer; and c) subjecting the polyolefin layer to a corona discharge treatment and not applying any subsequent layers thereover.

DESCRIPTION OF THE PREFERRED EMBODIMENTS

It has been found quite unexpectedly that a CDT of the backside film layer during the manufacturing process, without the application of any additional coating layers, can significantly improve the print registration of the color patch images applied from a dye-donor element. Other surface treatment teachniques may also be used such as a flame or plasma treatment.

CDT is commonly used in the art to promote adhesion of a subsequently applied layer. In this invention, after the CDT, there is no further layer applied over the polyolefin layer.

CDT is well known in the art and generally involves subjecting a surface to the effects of ionizing radiation produced by a corona discharge, i.e., an electrical discharge from an electrode onto a surface. During CDT, reactive chemical species, such as oxygen and/or nitrogen-containing groups, are introduced into the polymer surface.

In a preferred embodiment of the invention, step a) comprises laminating to a support on the front side thereof, in order, a biaxially-oriented composite film and a dye image-receiving layer, the composite film comprising a microvoided thermoplastic core layer and at least one substantially void-free thermoplastic surface layer. In another preferred embodiment of the invention, the microvoided thermoplastic core layer and the substantially void-free thermoplastic surface layer(s) are both polypropylene.

The support used in the invention can be, for example, a polymeric, a synthetic paper, or a cellulose fiber paper support, such as a water leaf sheet of wood pulp fibers or alpha pulp fibers, etc.

The polyolefin film laminated to the back side of the support can be, for example, biaxially-oriented polyolefin films such as polyethylene, polypropylene, polymethylpentene, and mixtures thereof. Polyolefin copolymers, including copolymers of ethylene and propylene are also useful. In a preferred embodiment, polypropylene is preferred. The thickness of the film can be from about 12 to about 75 $\mu$m.

The polyolefin film can be laminated to the support using a tie layer such as a polyolefin such as polyethylene, polypropylene, etc., if desired.

Due to their relatively low cost and good appearance, composite films are generally used and referred to in the trade as "packaging films." The low specific gravity of microvoided packaging films (preferably between 0.3–0.7 g/cm$^3$) produces dye-receivers that are very conformable and results in low mottle-index values of thermal prints. These microvoided packaging films also are very insulating and produce dye-receiver prints of high dye density at low energy levels. The nonvoided skin produces receivers of high gloss and helps to promote good contact between the dye-receiving layer and the dye-donor film. This also enhances print uniformity and efficient dye transfer.

Microvoided composite packaging films are conveniently manufactured by coextrusion of the core and surface layers, with subsequent biaxial orientation, whereby voids are formed around void-initiating material contained in the core layer. Such composite films are disclosed in, for example, U.S. Pat. No. 4,377,616, the disclosure of which is incorporated by reference.

The core of the composite film should be from 15 to 95% of the total thickness of the film, preferably from 30 to 85% of the total thickness. The nonvoided skin(s) should thus be from 5 to 85% of the film, preferably from 15 to 70% of the thickness. The density (specific gravity) of the composite film should be between 0.2 and 1.0 g/cm$^3$, preferably between 0.3 and 0.7 g/cm$^3$. As the core thickness becomes less than 30% or as the specific gravity is increased above 0.7 g/cm$^3$, the composite film starts to lose useful compressibility and thermal insulating properties. As the core thickness is increased above 85% or as the specific gravity becomes less than 0.3 g/cm$^3$, the composite film becomes less manufacturable due to a drop in tensile strength and it becomes more susceptible to physical damage. The total thickness of the composite film can range from 20 to 150 $\mu$m, preferably from 30 to 70 $\mu$m. Below 30 $\mu$m, the microvoided films may not be thick enough to minimize any inherent non-planarity in the support and would be more difficult to manufacture. At thicknesses higher than 70 $\mu$m, little improvement in either print uniformity or thermal efficiency is seen, and so there is little justification for the further increase in cost for extra materials.

The nonvoided skin layers of the composite film can be made of the same polymeric materials as listed above for the core matrix. The composite film can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these films. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the film or the manufacturability of the film.

In one preferred embodiment, in order to produce receiver elements with a desirable photographic look and feel, it is preferable to use relatively thick paper supports (e.g., at least 120 $\mu$m thick, preferably from 120 to 250 $\mu$m thick) and relatively thin microvoided composite packaging films (e.g., less than 50 $\mu$m thick, preferably from 20 to 50 $\mu$m thick, more preferably from 30 to 50 $\mu$m thick).

The dye image-receiving layer of the receiving elements prepared by the process of the invention may comprise, for example, a polycarbonate, a polyurethane, a polyester, poly (vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 10 g/m$^2$. An overcoat layer may be further coated over the dye-receiving layer, such as described in U.S. Pat. No. 4,775,657, the disclosure of which is incorporated by reference.

Dye-donor elements that are used with the dye-receiving element prepared by the process of the invention conventionally comprise a support having thereon a dye-containing layer. Any dye can be used in such dye-donor elements provided it is transferable to the dye-receiving layer by the action of heat. Especially good results have been obtained with sublimable dyes. Such dye donor elements are described, e.g., in U.S. Pat. Nos. 4,916,112; 4,927,803 and 5,023,228, the disclosures of which are incorporated by reference.

In a preferred embodiment of the invention, such a dye-donor element employed comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements prepared by the process of the invention are available commercially. There can be employed, for example, a Fujitsu Thermal Head (FTP-040 MCS001), a TDK Thermal Head F415 HH7-1089 or a Rohm Thermal Head KE 2OO8-F3. Alternatively, other known sources of energy for thermal dye transfer may be used, such as lasers as described in, for example, GB No. 2,083,726A.

The following example is provided to further illustrate the invention.

EXAMPLE

Thermal dye-receiver elements were prepared for the experimental work as described below.

Preparation of the Microvoided Support

The receiver support samples were prepared in the following manner. Commercially available packaging films (OPPalyte® 350 K18 and BICOR® 70 MLT made by Mobil Chemical Co.) were extrusion-laminated to the paper stock described below. OPPalyte® 350 K18 is a composite film (36 $\mu$M thick) (d=0.62) consisting of a microvoided and oriented polypropylene core (approximately 73% of the total film thickness), with a titanium dioxide pigmented non-microvoided oriented polypropylene layer on each side; the void-initiating material is poly(butylene terephthalate). BICOR® 70 MLT is an oriented polypropylene film (18 $\mu$m thick). Reference is made to U.S. Pat. No. 5,244,861 where details for the production of this laminate are described.

Packaging films may be laminated in a variety of ways (by extrusion, pressure, or other means) to a paper support. In the present context, they were extrusion-laminated as described below with pigmented polyolefin on the frontside (image side) and clear polyolefin on the backside of the paper stock support. The OPPalyte® 350 K18 film was laminated on the frontside and the BICOR® 70 MLT film was laminated on the backside. The pigmented polyolefin (12 g/m$^2$) contained anatase titanium dioxide (12.5% by weight) and a benzoxazole optical brightener (0.05% by weight). The clear polyolefin was high density polyethylene (12 g/m$^2$).

For test samples E-1 and E-2, the outermost side of the BICOR® 70 MLT film (the matte finish side) was corona treated after it was first extrusion-laminated to the backside of the paper stock. This was followed by extrusion-lamination of the frontside with OPPalyte® 350 K18 film. For this experiment, the corona discharge treatment level was set at 5.5 kilowatts. Acceptable surface treatment levels could also be achieved at settings between 4 and 6.5 kilowatts.

The paper stock was 137 μm thick and made from a 1:1 blend of Pontiac Maple 51 (a bleached maple hardwood kraft of 0.5 μm length weighted average fiber length) available from Consolidated Pontiac, Inc., and Alpha Hardwood Sulfite (a bleached red-alder hardwood sulfite on 0.69 μm average fiber length), available from Weyerhauser Paper Co.

Preparation of the Thermal Dye Transfer Receiver Elements

Thermal dye-transfer receiving elements were prepared and are designated below as test samples E-1 and E-2 and control receiver elements C-1 and C-2, respectively, by coating the following layers in order on the top surface of the frontside microvoided packaging film OPPalyte® 350 K18:

a) a subbing layer of Prosil® 221 (aminopropyltriethyoxysilane) and Prosil® 2210 (aminofunctional epoxysilane) (PCR, Inc.) (1:1 weight ratio) and LiCl (0.0022 g/m$^2$) in an ethanol-methanol-water solvent mixture. The resultant solution (0.10 g/m$^2$) contained approximately 1% of silane component, 3% water, and 96% of 3A alcohol;

b) a dye-receiving layer containing Makrolon® KL3-1013 (a polyether-modified bisphenol-A polycarbonate block copolymer (Bayer AG) (1.52 g/m$^2$), Lexan® 141-112 bisphenol-A polycarbonate (General Electric Co.) (1.24 g/m$^2$), Fluorad® FC-431 a perfluorinated alkylsulfonamidoalkylester surfactant (3M Co.) (0.011 g/m$^2$), Drapex® 429 polyester plasticizer (Witco Corp.) (0.23 g/m$^2$), 8 μm crosslinked divinylbenzene elastomeric beads (Eastman Kodak Co.) (0.006 g/m$^2$), and diphenyl phthalate (0.46 g/m$^2$) was coated from dichloromethane; and c) a dye-receiver overcoat coated from a solvent mixture of methylene chloride and trichloroethylene; contained a polycarbonate random terpolymer of bisphenol-A (50 mole-%), diethylene glycol (49 mole-%), and polydimethylsiloxane (1 mole-%) (2,500 MW) block units (0.55 g/m$^2$); a bisphenol A polycarbonate modified with 50 mole-% diethylene glycol (2,000 MW) (0.11 g/m$^2$); Fluorad® FC-431 surfactant (0.022 g/m$^2$); and DC-510® surfactant (Dow Corning Corp.) (0.003 g/m$^2$).

Control receiver elements C-1 and C-2 were prepared in an identical manner as described above for test samples E-1 and E-2, except that there had been no corona discharge treatment applied to the outermost side of the BICOR® 70 MLT film during the extrusion-lamination process as outlined above. These control receiver elements are described in U.S. Pat. No. 5,612,283 as Invention 1 in the Example.

Measurement of Registration on Printed Test Samples and Control Elements

To insure that test samples E-1 and E-2 had received a corona discharge treatment on the backside and control receiver elements C-1 and C-2 had not, a contact angle measurement was performed on the backside of all samples. This test, described in TAPPI Test Method T 458 om-89, was performed with distilled water at 50% RH/23° C. on the Kodak Contour Projector. Contact angle results are shown in the Table below.

The level of misregistration is determined through evaluation of the engine-mode test print pattern which is resident in the KODAK XLS 8600® and DS 8650® Thermal Printers. The digital image file content includes registration marks at each of its four corners. The digital file has "In-Track" registration marks of width 0.0152 cm (0.006") perpendicular to the long edge of the print and "X-Track" registration marks of width 0.0152 cm (0.006") parallel to the long edge of the print. Both "In-Track" and "X-Track" registration marks consist of yellow, magenta and cyan lines directly superimposed upon each other.

Once this digital file is printed , the registration marks are examined using a 7X loupe and the imaged width of each set of lines measured to the nearest 0.0025 cm (0.001"). The imaged width of "In-Track" marks minus 0.0152 cm (0.006") is referred to as the "In-Track Misregistration" and the imaged width of the "X-Track" marks minus 0.0127 cm (0.005") is referred to as the "Cross-Track Misregistration". Each of the four corners are similarly evaluated and the results averaged to give "Average In-Track Misregistration" and "Average Cross-Track Misregistration" respectively.

Multiple copies of the test-print were produced using different KODAK XLS 8600® and KODAK DS 8650® thermal printers and under a variety of environmental conditions to test the impact of the media variations in question. The following results were obtained:

TABLE

| Sample ID | In-Track Misregistration (cm) | X-Track Misregistration (cm) | Average Misregistration (cm) | Contact Angle (degrees) |
|---|---|---|---|---|
| E-1 | 0.0119 | 0.0099 | 0.0109 | 72 |
| E-2 | 0.0145 | 0.0097 | 0.0122 | 68 |
| C-1 | 0.0226 | 0.0104 | 0.0165 | 88 |
| C-2 | 0.0206 | 0.0112 | 0.0160 | 88 |

The above data in the Table show that misregistration (In-Track and X-Track) is significantly reduced with receiver elements having been subjected to a corona discharge treatment according to the invention, E-1 and E-2, as compared to the control elements, C-1 and C-2 which did not have such treatment.

The contact angle data show that samples E-1 and E-2, which have been corona-treated, have lower contact angles as measured by the procedure described above (better wetting) than do C-1 and C-2. The corona discharge treatment typically raises the surface energy making the surface more receptive to wetting.

The invention has been described in detail with particular reference to preferred embodiments thereof, but it will be understood that variations and modifications can be effected within the spirit and scope of the invention.

What is claimed is:

1. A process of preparing a dye-receiving element for thermal dye transfer comprising:

a) applying to a support on the front side thereof a dye image-receiving layer;

b) applying to the back side of said support a polyolefin layer; and c) subjecting said polyolefin layer to a corona discharge treatment and not applying any subsequent layers thereover.

2. The element of claim 1 wherein said polyolefin layer is polypropylene.

3. The element of claim 1 wherein said support is paper.

4. The element of claim 1 wherein the contact angle on said polyolefin film is less than 80° as measured by TAPPI Test Method T 458 om-89 using distilled water.

5. The element of claim 1 wherein step a) comprises laminating to a support on the front side thereof, in order, a biaxially-oriented composite film and a dye image-receiving layer, said composite film comprising a microvoided thermoplastic core layer and at least one substantially void-free thermoplastic surface layer.

6. The element of claim 5 wherein said core layer of said composite film comprises from 30 to 85% of the thickness of said composite film.

7. The element of claim 5 wherein said microvoided thermoplastic core layer has a substantially void-free thermoplastic surface layer on each side thereof.

8. The element of claim 5 wherein said microvoided thermoplastic core layer and said at least one substantially void-free thermoplastic surface layer are both polypropylene.

9. The element of claim 5 wherein the thickness of said composite film is from 30 to 70 $\mu$m.

* * * * *